United States Patent [19]

Wiggs et al.

[11] Patent Number: 4,869,506

[45] Date of Patent: Sep. 26, 1989

[54] LOGICAL PUZZLE

[76] Inventors: Christopher C. Wiggs; Christopher J. C. Taylor, both of 10 Lambton Place, Westbourne Grove, London, United Kingdom, W11 2SH

[21] Appl. No.: 225,697

[22] Filed: Jul. 29, 1988

[30] Foreign Application Priority Data

Dec. 23, 1987 [GB] United Kingdom ..... 8729979

[51] Int. Cl.[4] ..... A63F 9/08

[52] U.S. Cl. ..... 273/155

[58] Field of Search ..... 273/153 S, 155

[56] References Cited

U.S. PATENT DOCUMENTS

| | | | |
|---|---|---|---|
| 3,134,593 | 5/1964 | Monigal | 273/1 G |
| 3,659,854 | 5/1972 | Sinden | 273/155 |
| 4,560,164 | 12/1985 | Darling | 273/155 |
| 4,632,399 | 12/1986 | Bern | 273/155 |

FOREIGN PATENT DOCUMENTS

| | | | |
|---|---|---|---|
| 1279646 | 12/1986 | U.S.S.R. | 273/155 |

*Primary Examiner*—Anton O. Oechsle

*Attorney, Agent, or Firm*—Edwin E. Greigg

[57] ABSTRACT

A mechanical puzzle has a three by three array four gear units at the corners and five split gears. Opposed faces of the gear units and split gears are visible through a transparent casing and apertures in the chassis. The gear units are selectively connected to the split gear halves by axially setting four selector gears by finger pressure on their stubs. Clock faces are marked round the apertures and the puzzle consists in turning the gear units by finger pressure and setting the selector gears so that pointers on the eighteen exposed faces tell the same time.

8 Claims, 6 Drawing Sheets

LOGICAL PUZZLE

FIELD OF THE INVENTION

This invention relates to a mechanical logical puzzle.

SUMMARY OF THE INVENTION

The present invention provides a logical puzzle comprising a casing having solid gears and pairs of split gears rotatably supported with their faces visible from opposed faces of the casing, and selector gears each journalled in the casing and axially movable between upper and lower positions to selectively connect a solid gear to adjacent upper and lower split gears.

Advantageously the puzzle has a 3 by 3 coplanar array of spur gears with four solid corner gears and five pairs of split gears constituting the array, and with a set of four selector gears located along the diagonals of the array and concealed within the casing except for protruding stub axles by which they are journalled and by which they may be slid by finger pressure between upper and lower positions.

In one form the puzzle has a pointer on each face of each solid or split gear and the solid and split gears have twelve teeth. The casing can be marked with twelve rotational positions defining a clock face at each aperture, and the object of the puzzle can be defined to be putting all the 'clocks' to the same time. The puzzle is not limited to this form, however, and the faces of the wheels could carry graphics information.

It is preferred that the gears, which are rotated by finger pressure on the solid wheels, should be rotatable in indexed steps (e.g. corresponding to one hour increments of time in the aforesaid clock puzzle). For this purpose detent means is resiliently engaged with the teeth of each split gear. The split gears of each pair are biased resiliently apart by interposed coil springs, the teeth of each gear being forced over cam domes on the concealed faces of the casing to converge the split gears against the resistance of the coil spring at each indexed step.

DESCRIPTION OF THE DRAWINGS

An embodiment of the invention will now be described, by way of example only, with reference to the accompanying drawings, in which.

DESCRIPTION OF PREFERRED EMBODIMENT

Figure 1:
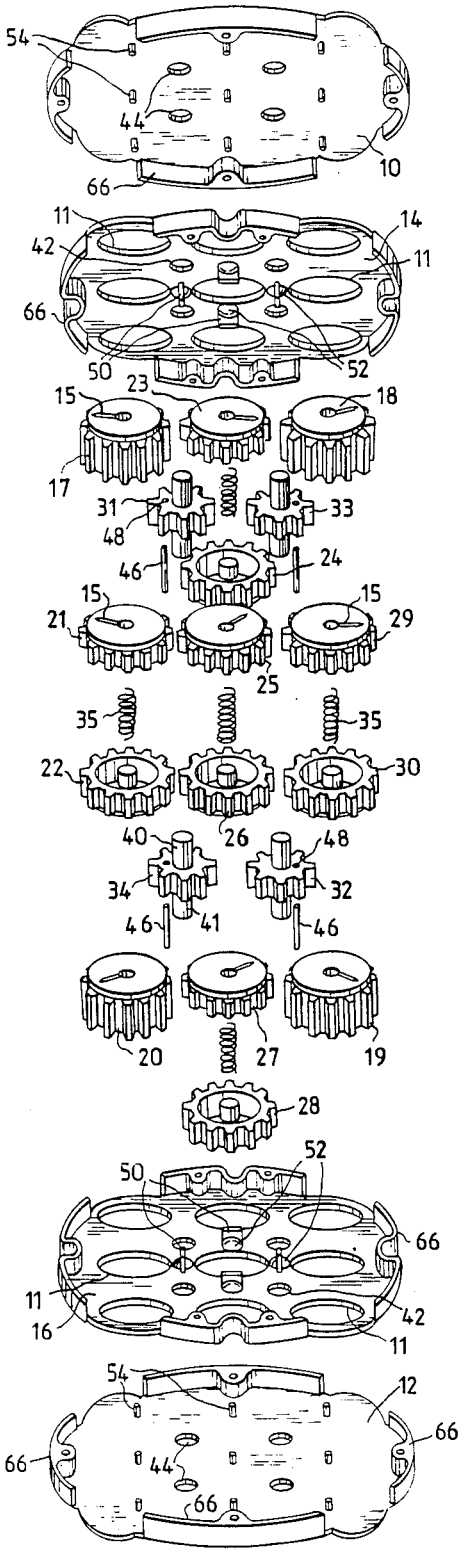
FIG. 1 is an exploded view of an embodiment of a logical puzzle according to the invention.
Figure 2:
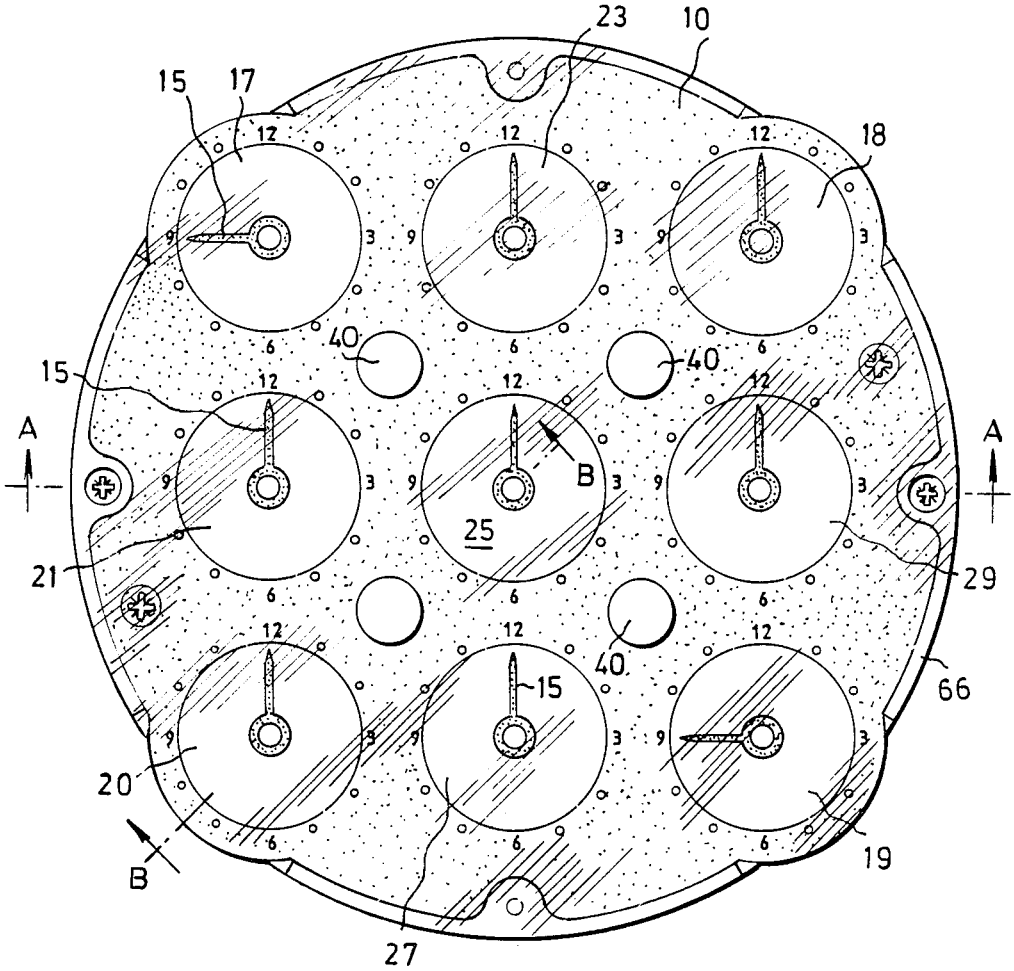
FIGS. 2 and 3 are respectively plan and underneath views of the logical puzzle shown in FIG. 1.
Figure 3:
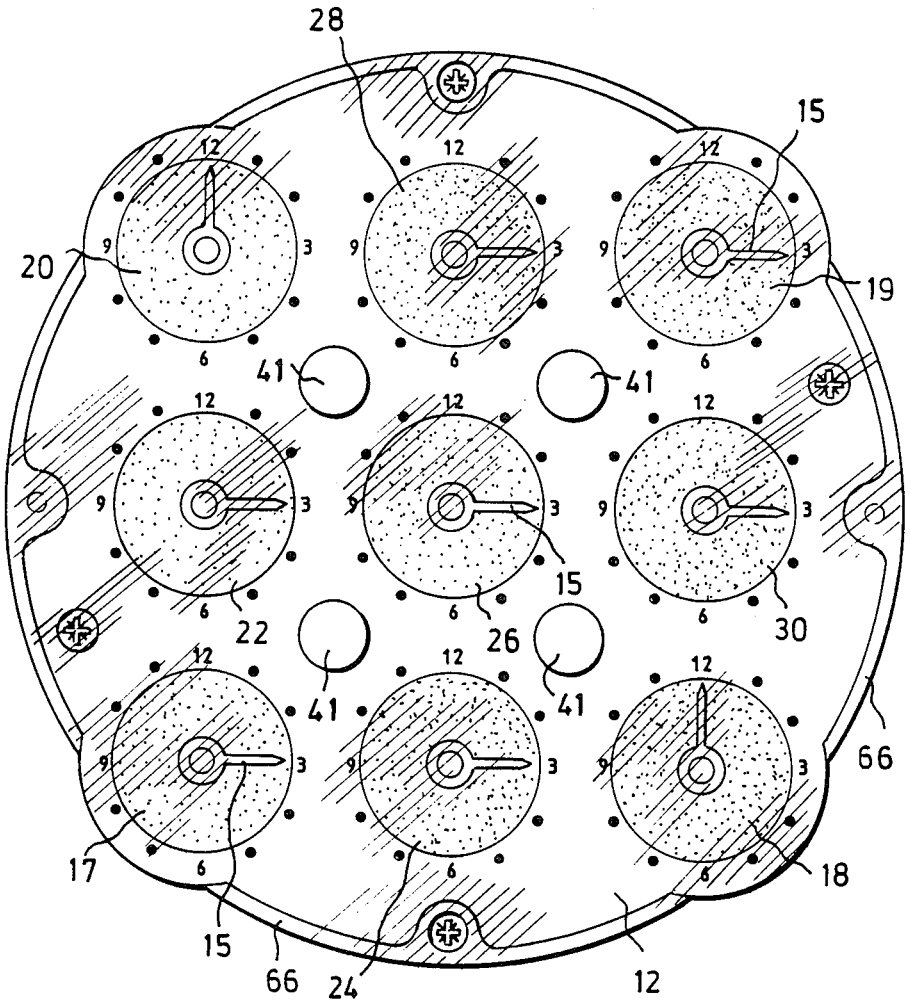

In the drawings, a gear puzzle has an outer case formed in transparent upper and lower halves 10,12 and an opaque graphics-bearing inner chassis formed in complementary upper and lower halves 14,16. The casing houses four corner gears 17–20, ten split gears 21–30 and four axialy movable change gears 31–34. The chassis halves are formed with apertures 11 into which the faces of the gear wheels 17–30 fit with clearance and which enable the said faces to be seen from the exterior of the puzzle. Each corner gear 17–20 has a pair of faces visible from the exterior of the puzzle, and each face has a visible marking such as a pointer 15 by means of which its rotational position relative to the puzzle casing is defined. Each split gear 21–30 has a single face visible from the exterior of the puzzle, and each said face likewise has a visible marking such as a pointer 13 by which its position relative to the puzzle casing is defined. The corner gears 17–20 are solid and occupy the full depth of the casing. The split gears occur in coaxial pairs, with the gears of each pair biased apart by a spring 35 so that each split gear is urged against the inner face of the chassis half 14 or 16. The axial dimensions of the split gears 21–30 are such that there is a small clearance between the gears of each pair so that the gears, which are biased apart by the spring 35, can move inwardly towards each other for a purpose described below. The split gears 21–30 are arranged with a central pair 25,26 at the intersection of diagonals joining corner gears 17–20 and with a pair of gears 21,22; 23,24; 27,28; 29,30 between each pair of corner gears. Connection between the above gears can be established selectively by change gears 31–34 equi-spaced along the diagonals joining centre split gears 25,26 and the corner gears 17–20.

Figure 5:
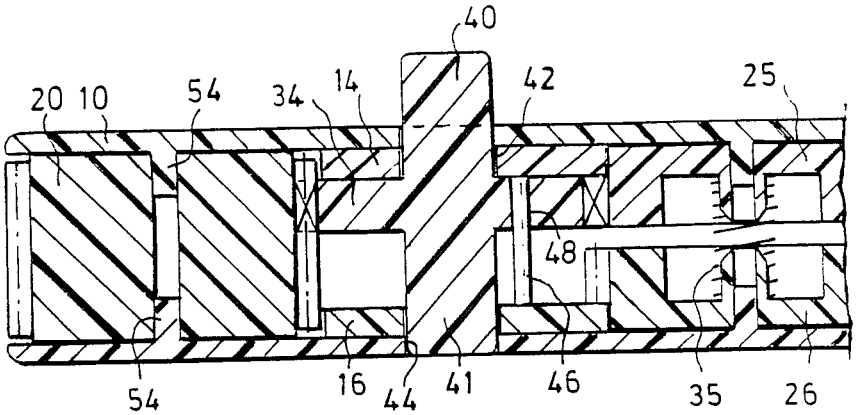
FIGS. 5 and 6 are diagrammatic fragmentary sections on the line B—B of FIG. 2 respectively showing two positions of a change gear.
Figure 6:
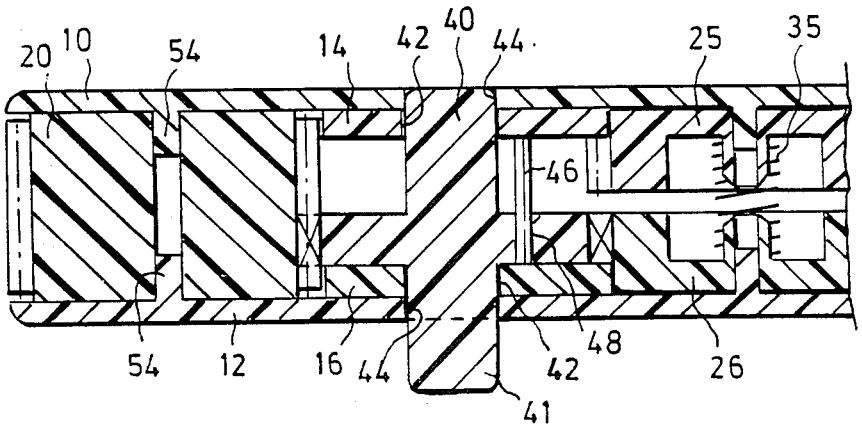

As seen in FIGS. 5 and 6 each change gear e.g. the gear 34 has upper and lower stub axles 40,41 that are journalled in holes 42 in the inner chassis halves 14, 16 and pass through corresponding holes 44 in the casing halves 10,12. The deptch of each change gear 31–34 is less than half the internal depth of the casing. Each change gear 31–34 is able to move axially against the resistance of a control pin 46 which is a light interference fit in a hole 48 through the gear 31–34 at a position just within the ring of teeth. The length of the pin 46 is equal to the internal depth of the casing. The stub axles 40,41 protrude a small distance so that finger pressure on one end and then the other displaces the change gear 34 from a position against the inner face of the chassis half 14 (FIG. 5) to a position against the inner face of the chassis half 16 (FIG. 6) or to an intermediate position.

Figure 4:
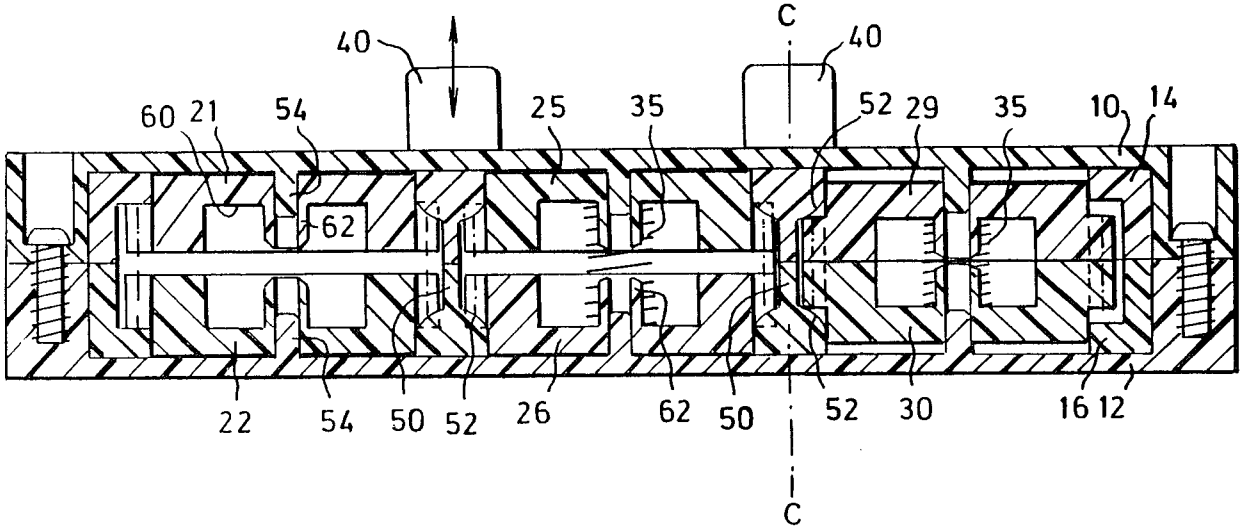
FIG. 4 is a diagrammatic section of the puzzle shown in FIGS. 1 to 3 on line A—A of FIG. 2, with the gears to the left of the chain dotted line C—C in FIG. 4 being shown in a normal position, and with gears to the right of that line in a displaced position.
Figure 7:
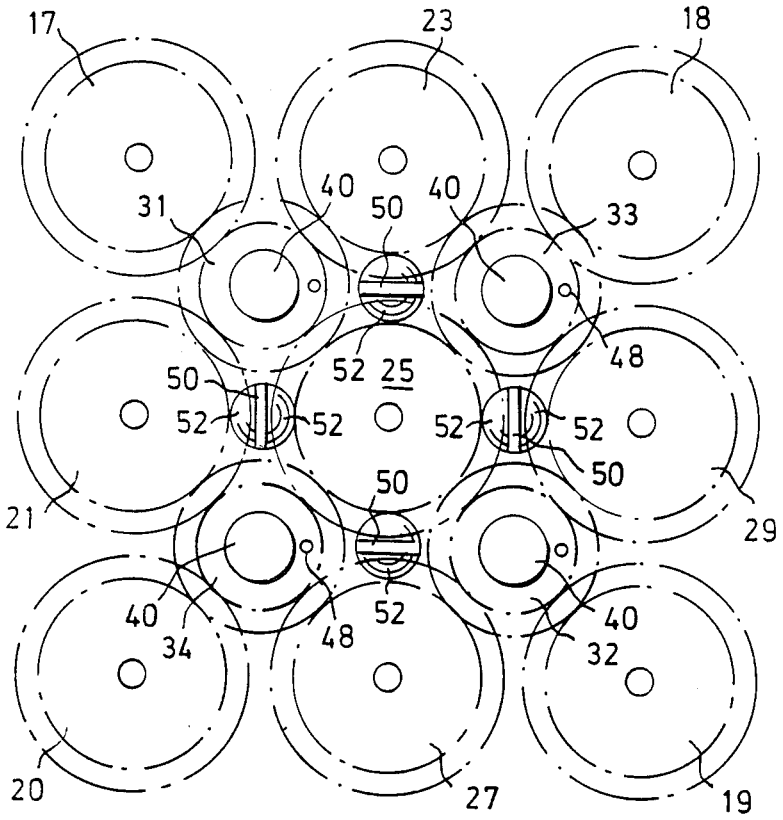
FIG. 7 is a fragmentary view on the inner face of a chassis half showing gear positions and means for controlling them.

The central pair of split gears 25,26 is surrounded by four posts 50 (FIGS. 4 and 7) on the inner face of each of the inner chassis halves 14,16. The posts 50 on the chassis halves abut when the halves are fastened together to give rigidity to the puzzle. Each post 50 meets the inner chassis half at a cam dome 52 dimensioned to fit between a pair of teeth of the split gears 21–30. The gears are formed with a relatively small number of teeth, the corner gears 17–20 and the split gears 21–30 having twelve teeth and the change gears having eight teeth. The gears 25,26 of the central pair are each controlled by four cam domes 52 and the gears of each peripheral pair are each controlled by one cam dome 52. The split gears 21–30 thus move in indexed steps in which a tooth passes over a dome 52 against the resistance of spring 35, the clearance between the gears in each pair being such as to allow the necessary inward movement to take place. In FIG. 4 the gears 21,22 and 25,26 are shown fully spaced as in a stable position, and the gears 29,30 are traversing cam domes 52 which cause them to converge against the resistance of spring 35.

The outer casing halves 10,12 are formed with stub axles 54 that rotatably support the corner gears 17–20 and the split gears 21–30. The split gears 21–30 are formed with recesses 60 on their blind faces, into which recesses project spigots 62 onto which the springs 35 fit as shown.

The change gears 31–34 connect a corner gear with one or the other, or possibly both, of the adjacent sets of three split gears. Thus in one position the change gear 33 connects corner gear 18 with either split gears 30,26,24 or split gears 29,25,23. In an intermediate position all seven gears are connected together, although this is less usual. At the moment that one corner gear which is accessible through one of four associated slots defined by flanges 66 on the halves 10, 12, 14, 16 from the exterior of the casing is turned by a user's finger, any other gears that are left in mesh are also turned via the change gear, which may or may not be discernible depending upon which face of the puzzle is directed to the operator. The difficulty of the puzzle is that although one face can be ordered relatively simply e.g. with all its pointers 13,15 parallel, this is usually at the expense of disordering the other face. Order or disorder can be perceived by the orientation of the marking lines or graphics 13,15 on the visible faces of the gears. It will be seen that, in the example, these consist of pointers marked respectively on all the exposed faces of the corner and split gears 17–30 and twelve-hour clock faces marked round each of the apertures 11 in the chassis halves 14, 16.

We claim:

1. A mechanical logical puzzle comprising a casing, means for supporting inside said casing a plurality of spur gear units presenting exposed faces and a plurality of split spur gears presenting exposed faces, a plurality of spur gear units and a plurality of split spur gears mounted in said supporting means, each split spur gear being split transversely between the exposed faces thereof into two coaxial parts mounted for relative rotation about its respective axis, said casing and said supporting means being formed for two different groups of said exposed faces to be visible respectively at opposed faces of said casing, further means inside said casing for supporting rotatably about individual axes a plurality of selector gears, a plurality of selector gears mounted in said further supporting means, each selector gear being movable along its individual axis to any selected one of at least two positions along its individual axis for connecting one of said spur gear units to at least one selected part of said split spur gears, whereby a selected setting of selector gears can enable rotation of one said spur gear to effect a modification of the relative settings of said exposed faces of said spur gear units and said split spur gears about their respective axes.

2. A mechanical logical puzzle according to claim 1, in which there are four of said spur gear units and five split spur gears arranged in a three by three coplanar array with the spur gear units disposed at the corners, and in which there are four selector gears located with two along each diagonal of the array so that the selector gears are distributed round a central split spur gear in the array, each selector gear being formed with axially opposed stub axles by which it is journalled in said further supporting means and by which it may be set by finger pressure in a selected one of said at least two selected positions.

3. A mechanical logical puzzle according to claim 2, in which a pointer is marked on each of said exposed faces of said spur gear units and said split spur gears, and in which each of said spur gear units and said split spur gears have twelve teeth, and said supporting means includes elements each marked with twelve positions defining a twelve-hour clock face, one surrounding each exposed face, an object of the puzzle being to put each 'clock' at the same time.

4. A mechanical logical puzzle according to claim 2, in which said casing is formed with openings providing access to the edges of said spur gear units, whereby said spur gear units can be rotated by finger pressure.

5. A mechanical logical puzzle according to claim 1, in which resiliently yielding detent means operative on each said spur gear unit and on each said split spur gear limits rotation thereof to indexed steps.

6. A mechanical logical puzzle according to claim 5, in which said yielding detent means is operative on each said part of each said split spur gear.

7. A mechanical logical puzzle according to claim 6, comprising a plurality of compression springs respectively interposed between said two parts of said split spur gears, whereby said two parts of each said split spur gear are biased apart, and cam domes fixed with respect to said casing located for each split tooth on each said split spur gear, on rotation thereof, to snap past two of said cam domes while urging said two parts of said split spur gear together against the action of its respective spring and then allowing the said two parts to separate.

8. A mechanical logical puzzle according to claim 1, in which said casing is formed with transparent walls and said supporting means and said further supporting means are separately formed to constitute a chassis located in said casing and formed with apertures through which exposed faces can be viewed through said casing.

* * * * *